US006736138B2

(12) United States Patent
Tayebi

(10) Patent No.: US 6,736,138 B2
(45) Date of Patent: May 18, 2004

(54) SEAMLESS PAD-TYPE FILTER

(76) Inventor: Amad Tayebi, 5 Sequoia Rd., Westford, MA (US) 01886

( * ) Notice: Subject to any disclaimer, the term of this patent is extended or adjusted under 35 U.S.C. 154(b) by 0 days.

(21) Appl. No.: 10/228,402

(22) Filed: Aug. 27, 2002

(65) Prior Publication Data

US 2004/0031489 A1 Feb. 19, 2004

Related U.S. Application Data

(60) Provisional application No. 60/315,187, filed on Nov. 10, 2001.

(51) Int. Cl.[7] ..... A62B 7/10; A62B 23/02

(52) U.S. Cl. ..... 128/205.27; 128/206.16; 128/206.17

(58) Field of Search ..... 128/200.24, 205.27, 128/206.12, 206.19, 206.16, 206.17

(56) References Cited

U.S. PATENT DOCUMENTS 4,886,058 A * 12/1989 Brostrom et al. ..... 128/206.12
5,035,236 A * 7/1991 Kanegaonkar ..... 128/201.13
5,240,479 A * 8/1993 Bachinski ..... 96/17
6,161,540 A * 12/2000 Fecteau ..... 128/205.27
6,309,438 B1 * 10/2001 Kanno et al. ..... 55/486
6,345,620 B2 * 2/2002 Salapow et al. ..... 128/206.17

* cited by examiner

*Primary Examiner*—Weilun Lo
*Assistant Examiner*—Michael Mendoza

(57) ABSTRACT

The present invention discloses a seamless pad-type filter which is characterized in that it comprises two co-extensive sides, a top side and a bottom side. The top and bottom sides are made of fluid filtration material. The two sides create an inner chamber therebetween and are surrounded and joined together by a seamless outer perimeter. The seamless outer perimeter providing a seamless folded continuity between the two sides of the pad-type filter in the form of a plurality of fold lines which, as connecting segments beginning and ending at the same point, define the seamless outer perimeter. The top side further comprising a plurality of positive and negative secondary creases formed around a plurality of positive and negative crease lines. The crease lines are inclined to the fold lines and form pleats. The pleats are sealed to form a primary flow aperture such that a fluid passing through said primary flow aperture passes only through at least one of the bottom side, the top side and the seamless outer perimeter.

2 Claims, 14 Drawing Sheets

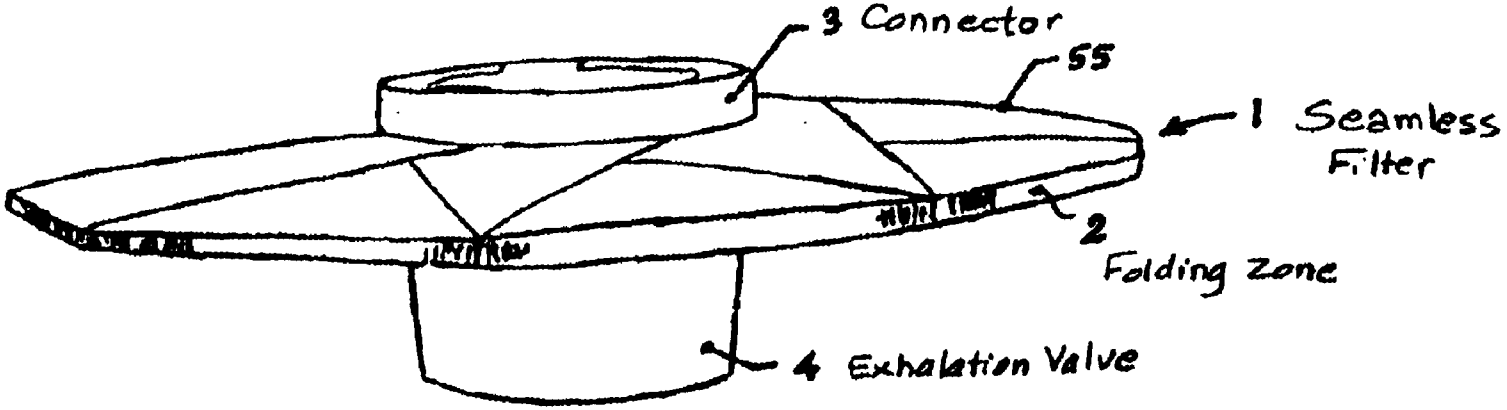
Figure (1)

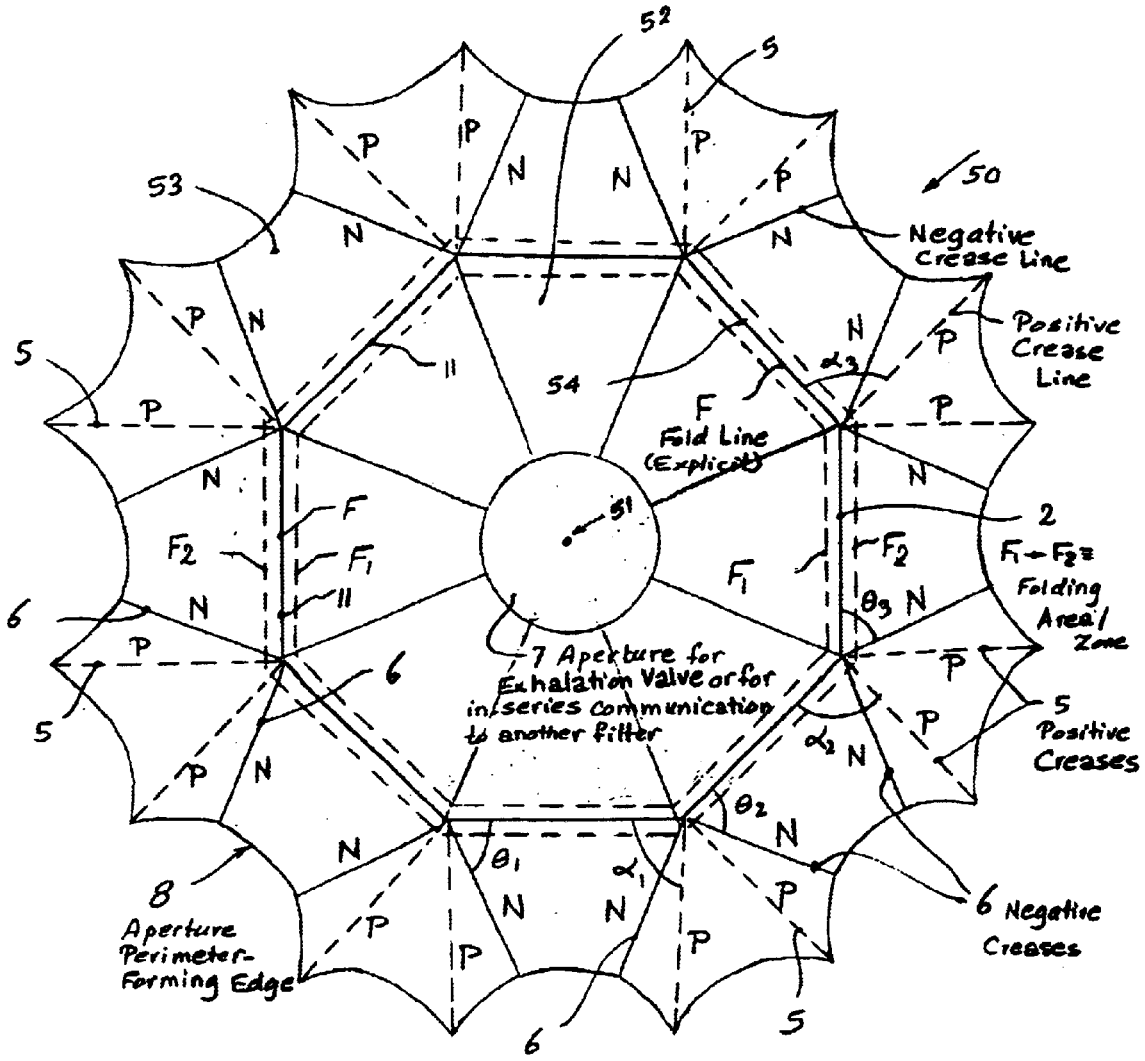
Figure (2)

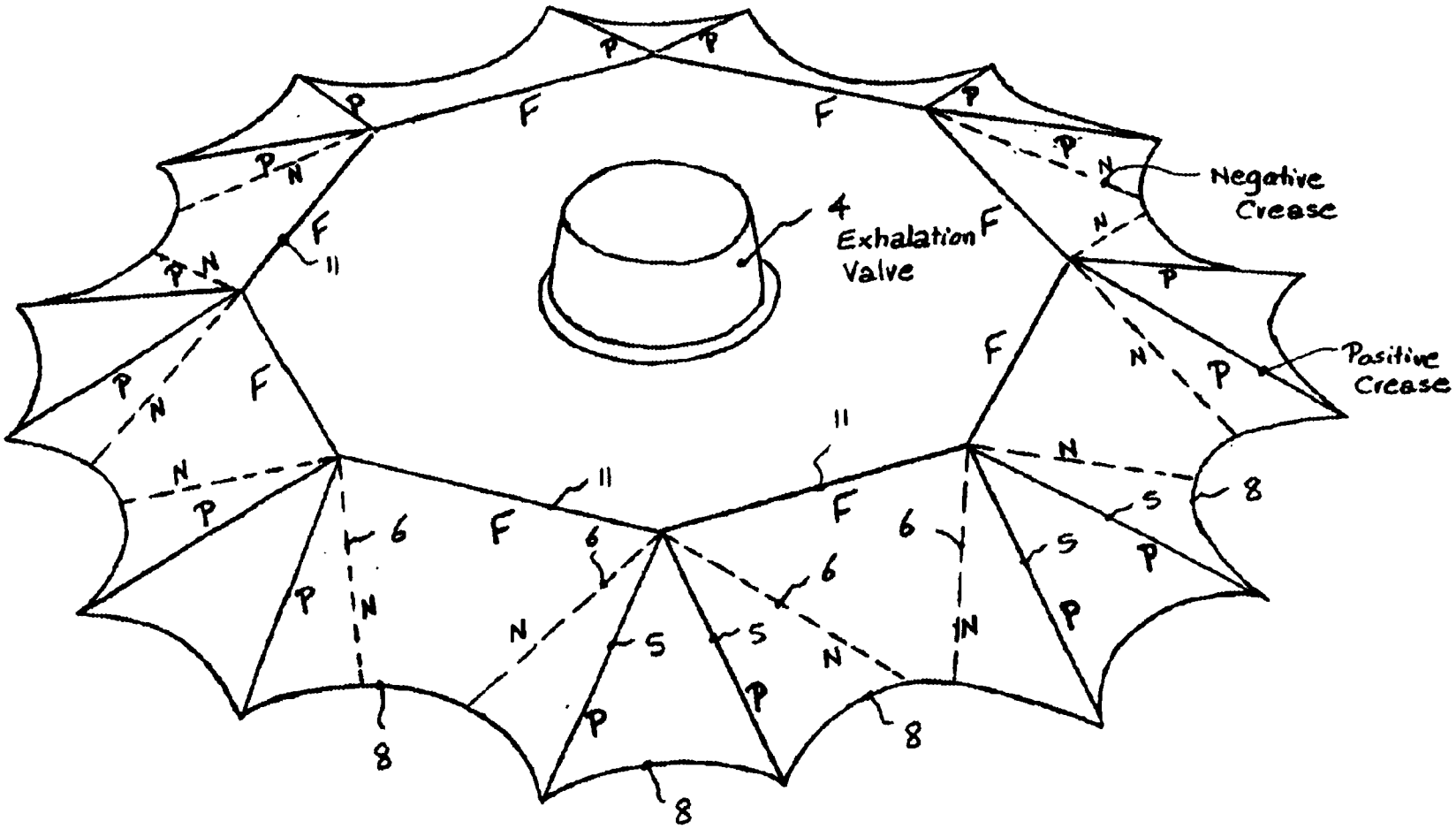
Figure (3)

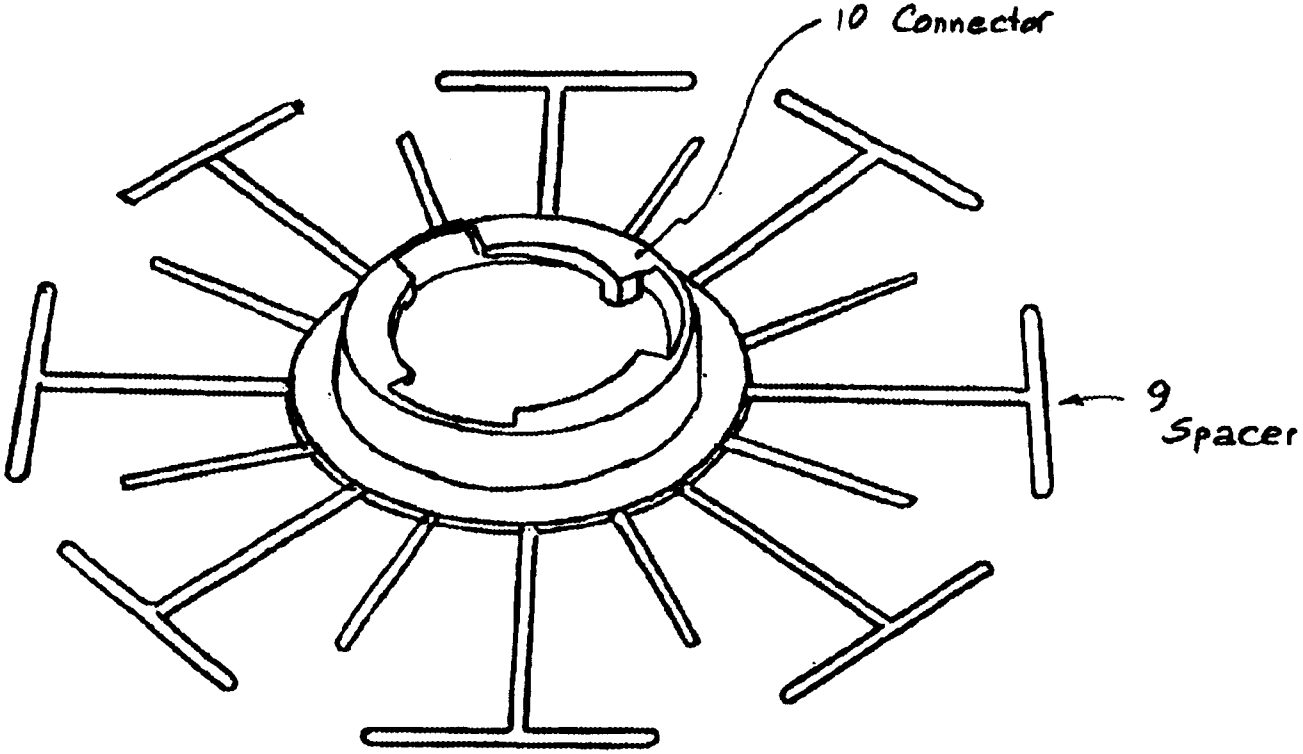
Figure (4)

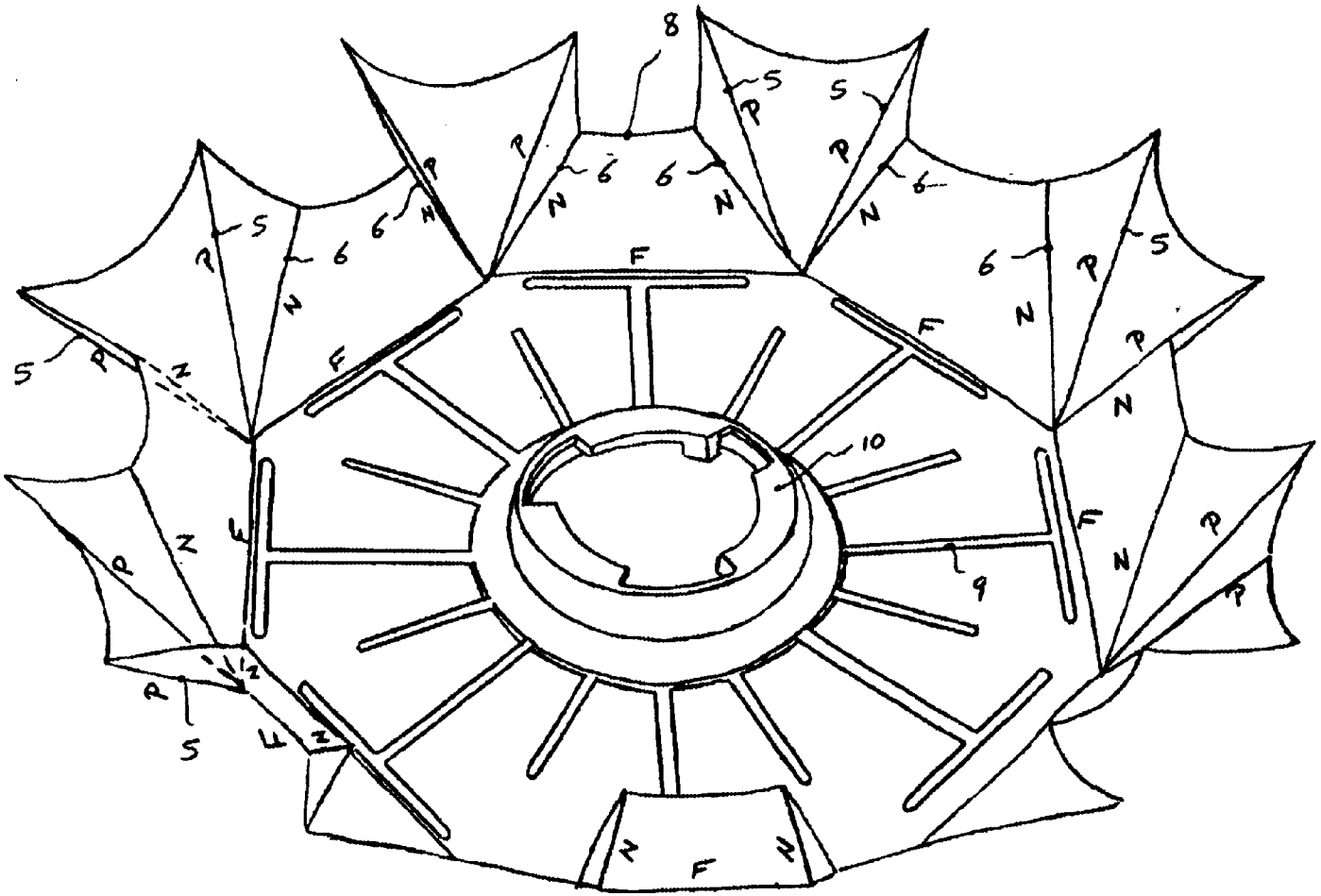
Figure (5)

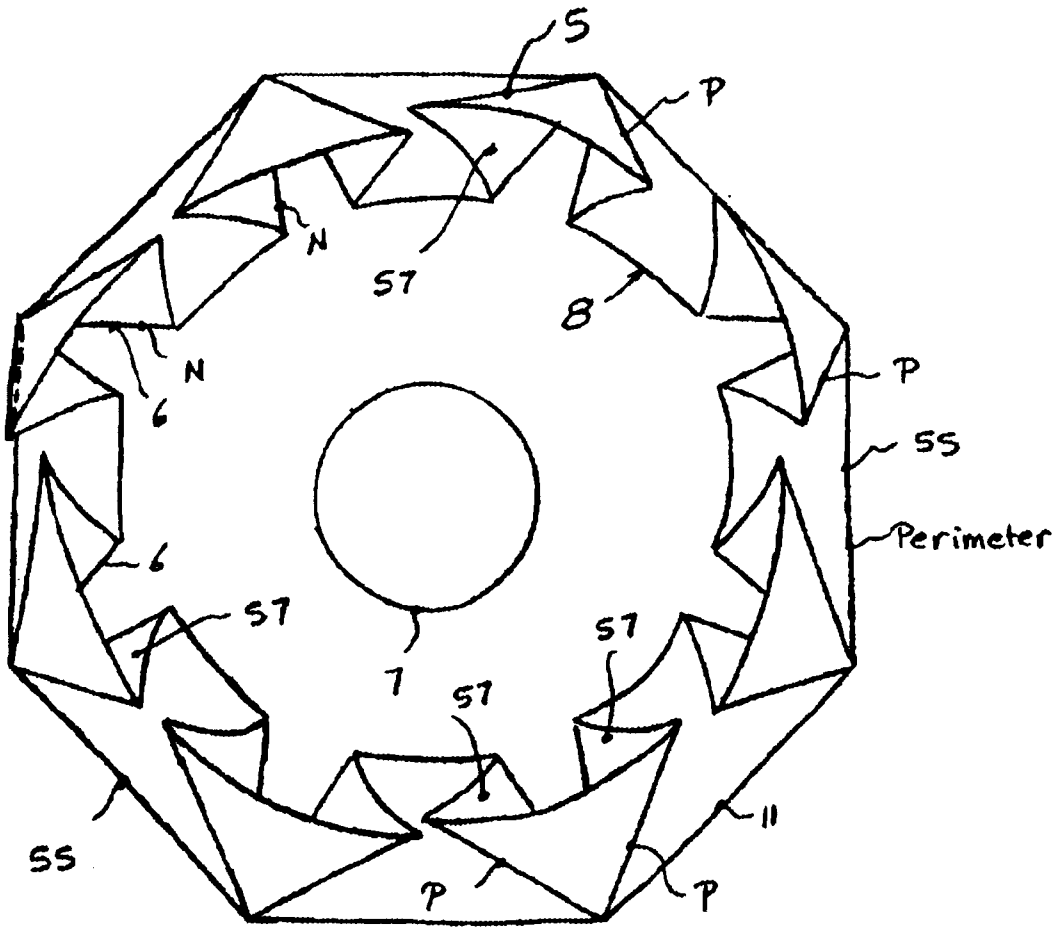
Figure (6)

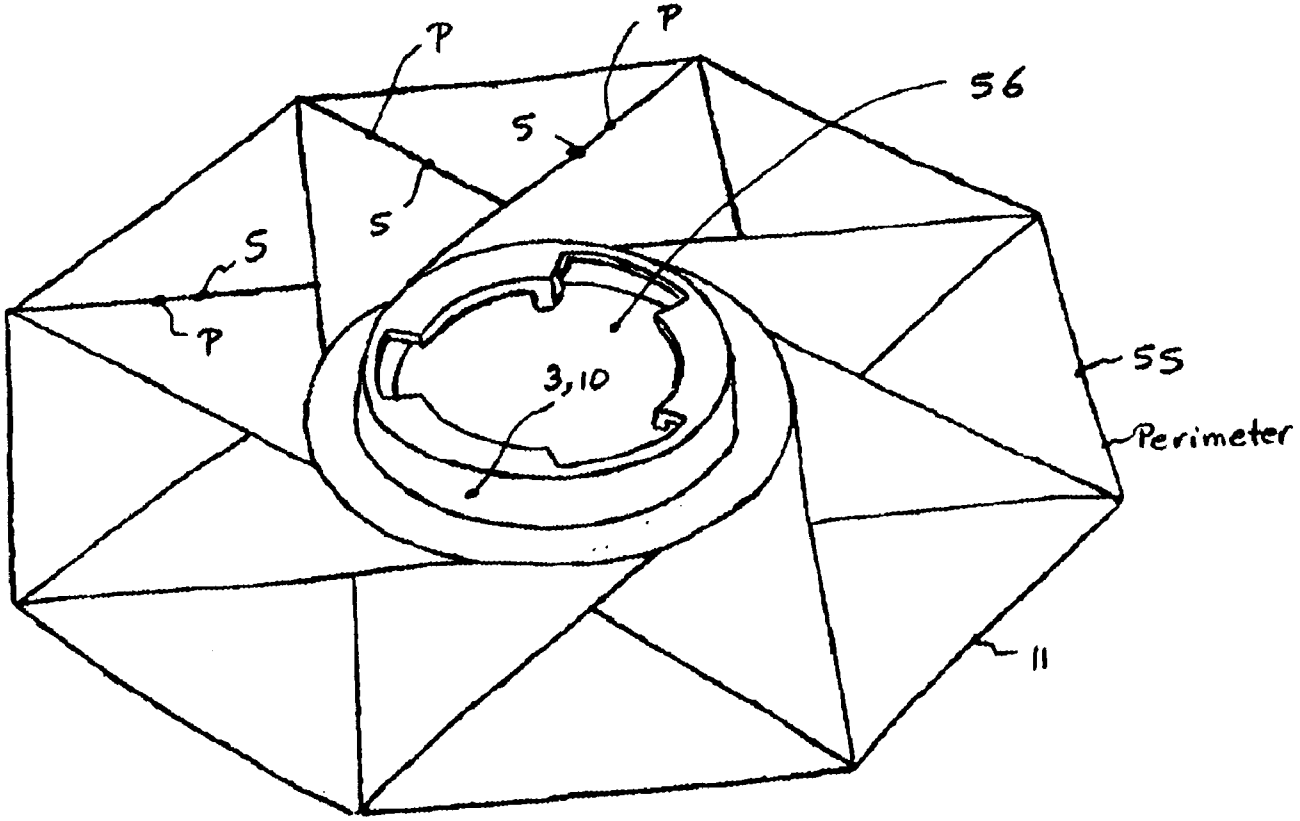
Figure (7)

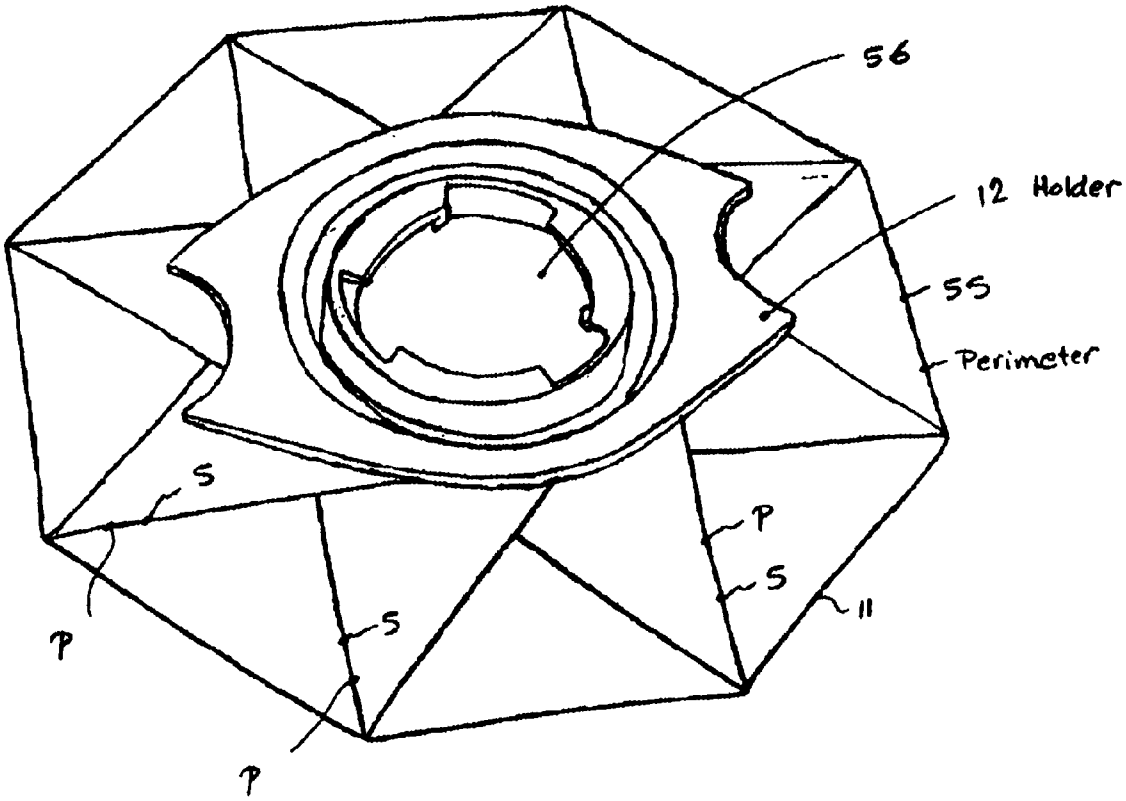
Figure (8)

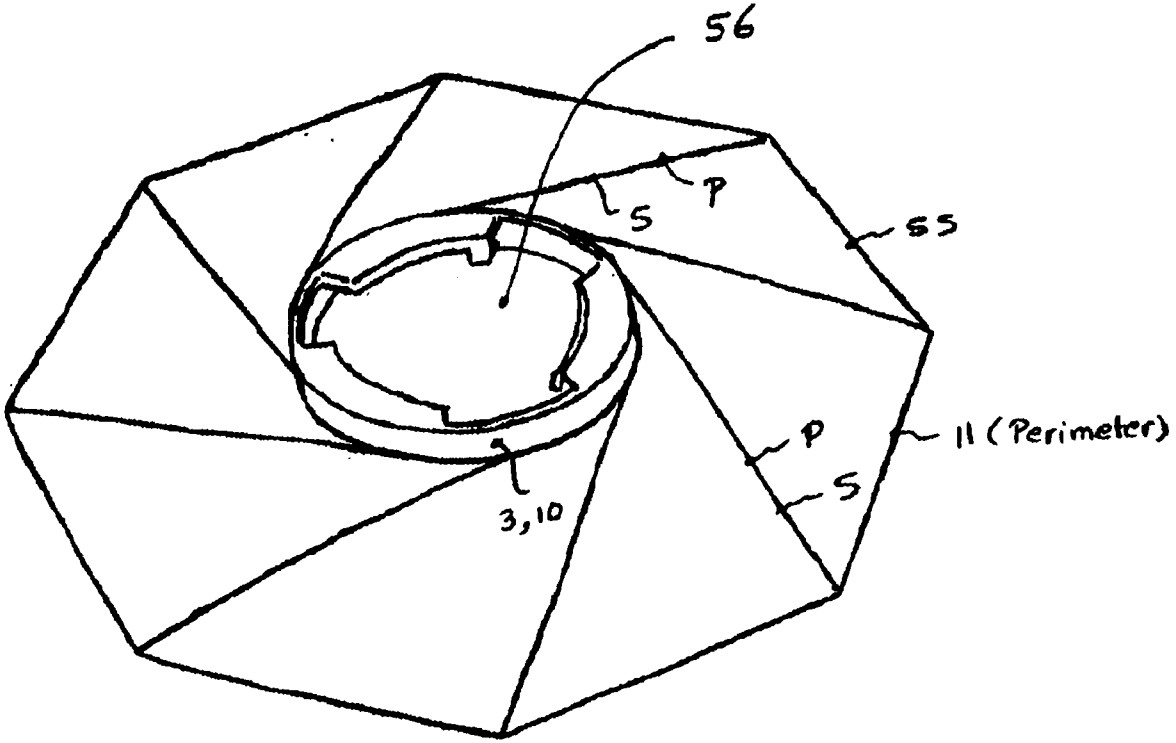
Figure (9)

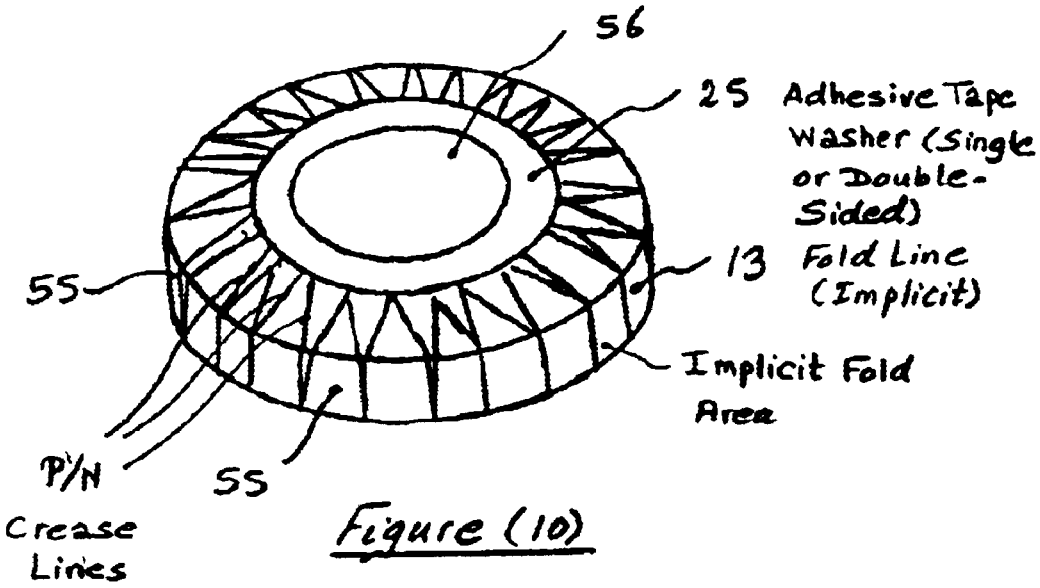
Figure (10)

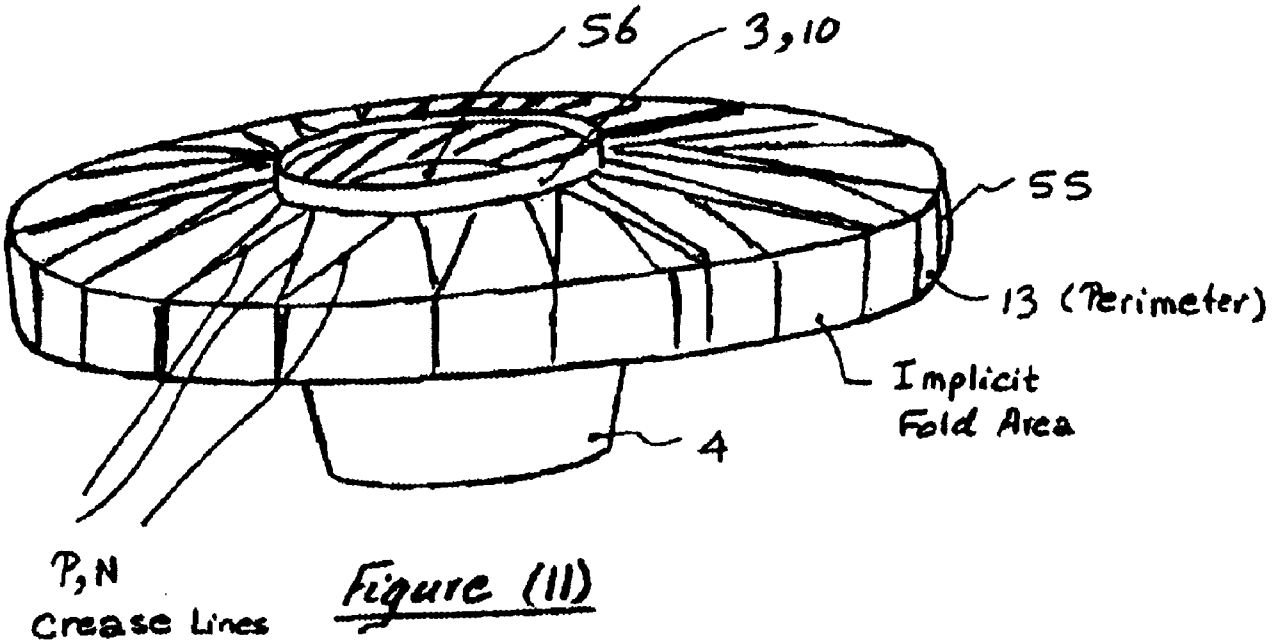
Figure (11)

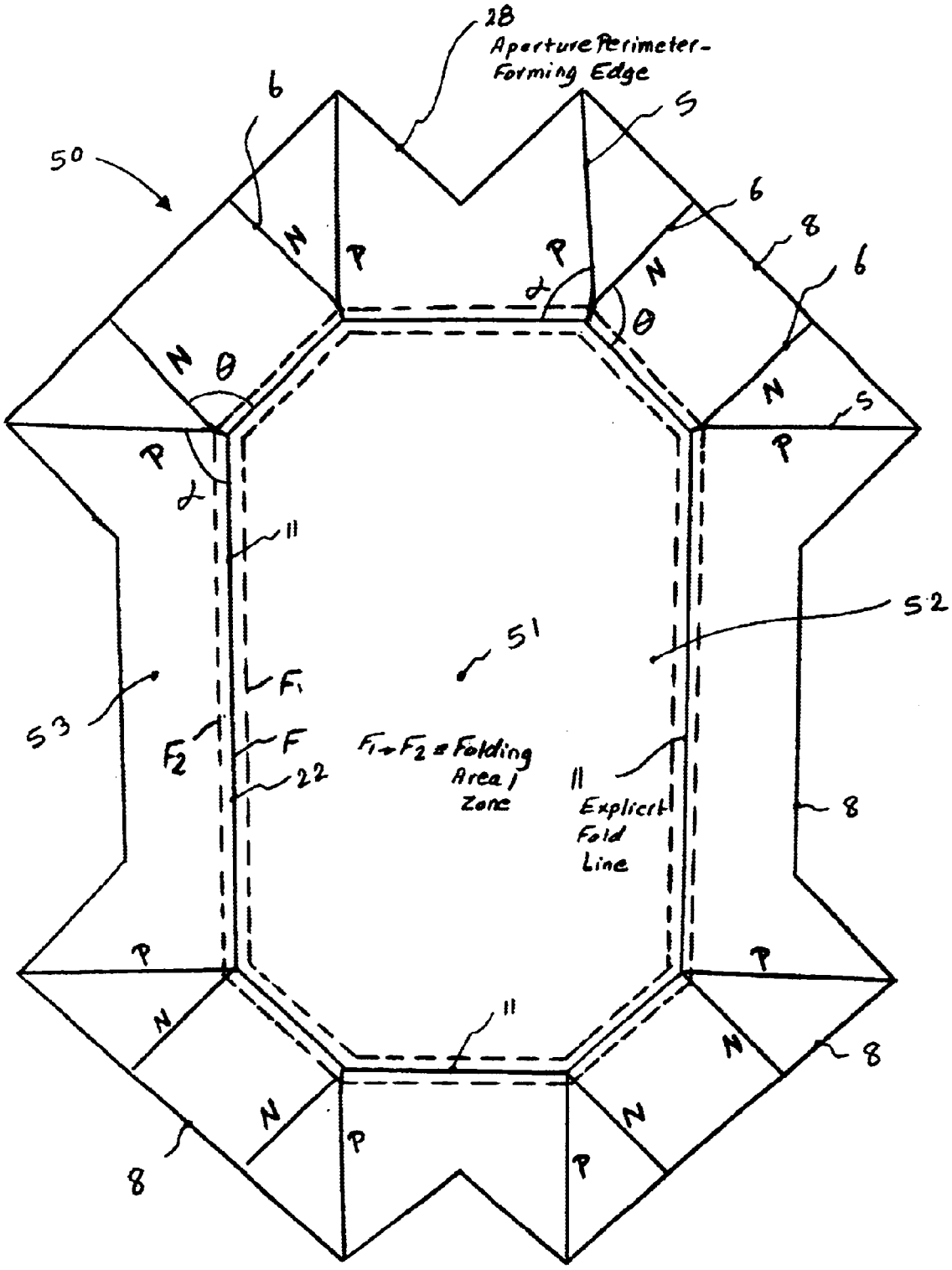
Figure (12)

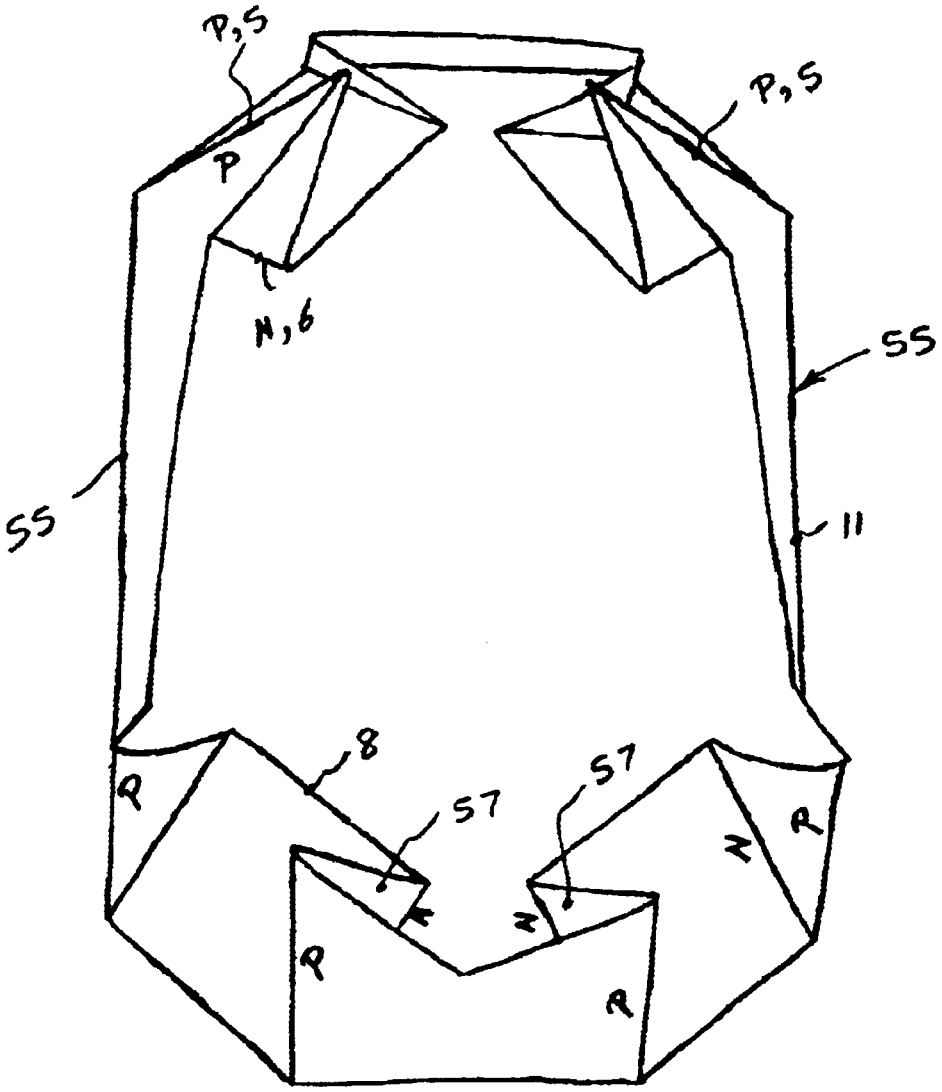
Figure (13)

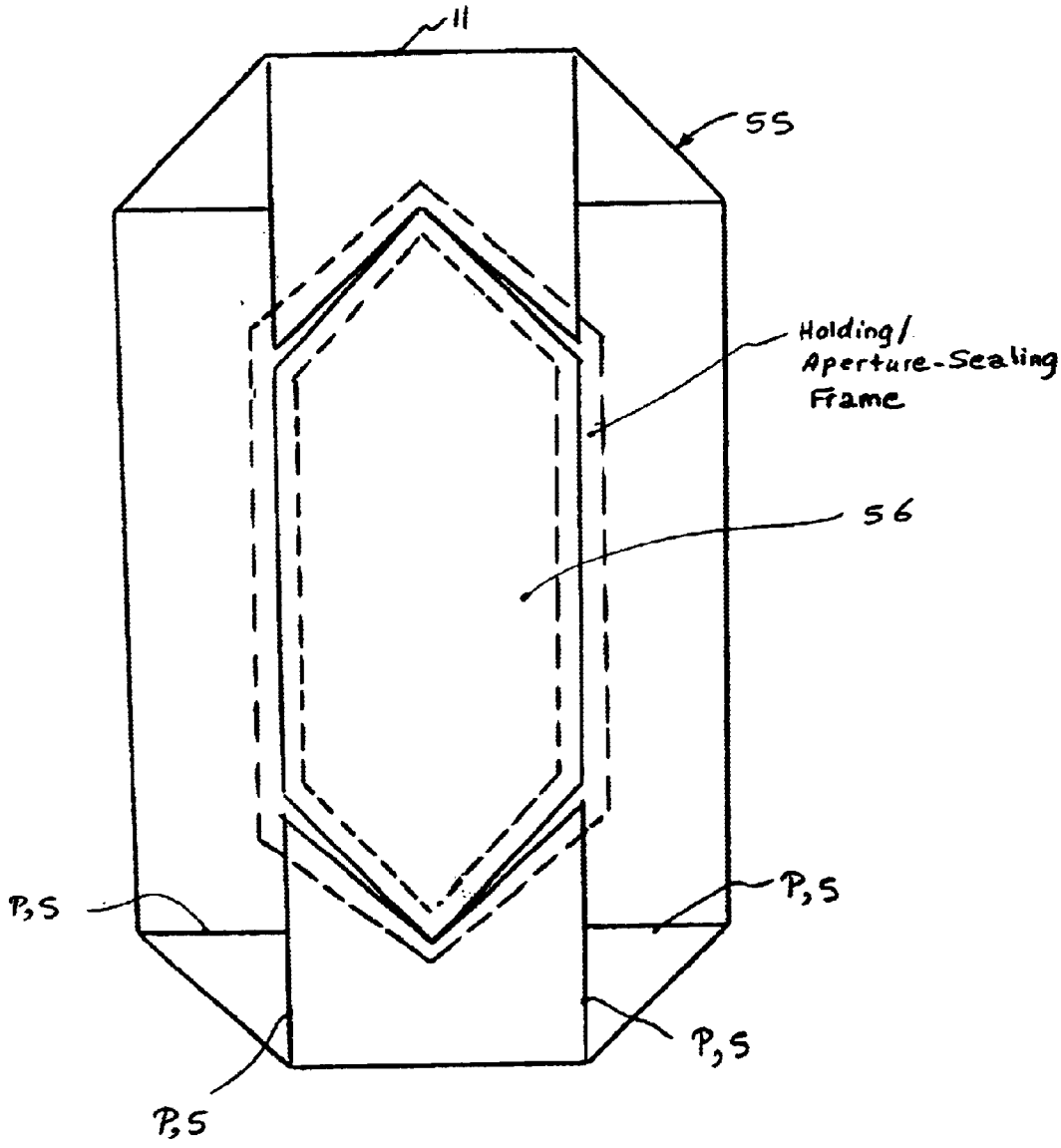
Figure (14)

SEAMLESS PAD-TYPE FILTER

This application claims a priority date of U.S. Provisional Patent Application No. 60/315,187, filed on Nov. 10, 2001, which is hereby incorporated, by reference, in this application.

FIELD

The present invention is in the field of fluid-purifying filters. In particular it teaches a seamless pad-type fluid purifying filter and a method for its manufacture.

BACKGROUND

The prior art teaches a variety of structures of pad-type filters and methods for their manufacture. Examples of such teachings are disclosed in U.S. Pat. Nos. Re: 35,062 (a 1995 reissue of U.S. Pat. No. 4,886,058, issued on Dec. 12, 1989), 6,345,620 and 5,992,414, all of which are incorporated in this application by reference. In addition, U.S. Pat. No. 6,309,438 which teaches a "filter unit and dust-proof mask therewith" and discloses highly efficient filtration media, such as biaxially expanded polytetrafluoroethylene porous films, is also incorporated in this application by reference.

In accordance with the present invention, a pad-type filter is defined as a filter comprising at least two layers of filtration media hermetically sealed to one another along a common perimeter and separated from one another by an inner chamber created therebetween and at least one opening in at least one of the layers such that a fluid passing through said opening passes only through at least one of the two layers. A pad-type filter thus offers a larger surface area for fluid flow than the projected area of the filter and, therefore, exhibits a lower overall resistance to flow at the same volume flow rate through the same filtration media than single layer filters having the same projected area. A significant disadvantage, however, of all pad-type filters of the prior art is that the sealed area adjacent to and around the common perimeter is highly compacted and inefficiently, if at all, utilized. Thus, such pad-type filters still suffer severe limitations on their filtration efficiency, resistance to flow and filtration material utilization efficiency. The seamless pad-type filter of the present invention overcomes the problems associated with prior art pad-type filters. In addition, the present invention provides, at more efficient material utilization and lower material and assembly costs, a method for manufacture of seamless pad-type filters. The pad-type filter of the present invention is characterized in that it eliminates the need for having to make a seal between the two sides of the filter along their common perimeter, as necessitated in the prior art.

BRIEF DESCRIPTION OF THE DRAWINGS

FIG. 1 is a perspective view of seamless filter.

FIG. 2 is a plan view of shaped perimeter filtration media.

FIG. 3 shows a sheet of filtration media during progressive folding.

FIG. 4 shows an internal connector and spacer.

FIG. 5 shows a sheet of filtration media during progressive folding around connector and spacer combination.

FIG. 6 shows a sheet filtration media during progressive folding and forming pleats.

FIG. 7 is a perspective view of seamless filter assembly.

FIG. 8 is a perspective view of seamless filter assembly.

FIG. 9 is a perspective view of seamless filter assembly.

FIG. 10 is a perspective view of seamless filter assembly featuring implicit fold area and randomly generated fold and crease lines.

FIG. 11 is a perspective view of seamless filter assembly featuring implicit fold area and randomly generated fold and crease lines.

FIG. 12 is a plan view of shaped-perimeter filtration media.

FIG. 13 shows a sheet of filtration media during progressive folding and forming pleats.

FIG. 14 is a top view of seamless filter assembly.

DESCRIPTION OF THE INVENTION

The method of making the seamless pad-type filter of the present invention is shown in FIGS. 1 to 14. It comprises the steps of:

i) Providing a sheet of fluid filtration media 50, as shown in FIGS. 2 and 12. As shown therein, the sheet of filtration media 50 has an upper (also referred to as an inner) surface and a lower (also referred to as an outer) surface and comprises a center point 51, a central zone 52, a shaped perimeter 8 and an intermediate zone 53. Center point 51 is located within central zone 52 and central zone 52 is located within intermediate zone 53. Shaped perimeter 8 defines the outer edge of the sheet of filtration media 50. A folding zone 54 surrounds central zone 52 and is surrounded by intermediate zone 53.

ii) Forming a plurality of primary folds within said folding zone 54. Each primary fold is formed around an axis the projection of which lies within said folding zone 54 and forms a fold line which is spaced apart from center point 51. The plurality of primary folds, so formed, a) creates a plurality of fold lines 11 which, as connecting segments beginning and ending at the same point, define formed pad-type filter outer perimeter 55 and b) forms a plurality of positive and negative secondary creases 5 and 6. A positive secondary crease causes inner surface segments of the sheet of filtration media to face one another in the creased state and a negative secondary crease causes outer surface segments of the sheet of filtration media to face one another in the creased state. Secondary creases 5 and 6 are formed around a plurality of positive and negative crease lines P and N, respectively. Crease lines P and N are inclined (i.e., non parallel) to the fold lines 11 at angles $\alpha^s$ and $\theta^s$ respectively. In so forming a plurality of fold lines 11, defining formed filter outer perimeter 55 and forming pluralities of positive and negative crease lines P and N, shaped perimeter 8 of the sheet of filtration media 50 is pleated into pleats 57, as shown in FIGS. 6 and 13 that form a primary flow aperture 56, as shown in FIGS. 7, 8, 9, 10, 11 and 14, and iii) sealing pleats 57 so formed such that a fluid passing through primary flow aperture 56 passes only through at least one of central zone 52, intermediate zone 53 and folding zone 54.

The seamless pad-type filter of the present invention is characterized in that it comprises two co-extensive sides, a top side and a bottom side. The top and bottom sides are made of fluid filtration material. The two sides create an inner chamber therebetween and are surrounded and joined together by a seamless outer perimeter. The seamless outer perimeter providing a seamless folded continuity between the two sides of the pad-type filter in the form of a plurality of fold lines which, as connecting segments beginning and ending at the same point, define the seamless outer perimeter. The top side further comprising a plurality of positive and negative secondary creases formed around a plurality of positive and negative crease lines. The crease lines are inclined to the fold lines and form pleats. The pleats are sealed to form a primary flow aperture such that a fluid passing through said primary flow aperture passes only through at least one of the bottom side, the top side and the seamless perimeter.

What is claimed is:

1. A method for making a seamless pad-type filter.

2. A seamless pad-type filter made in accordance with the method of claim 1, comprising:

two co-extensive sides, a top side and a bottom side, said top and bottom sides are made of fluid filtration material, said two sides creating an inner chamber therebetween and being surrounded and joined together by a seamless outer perimeter, said seamless outer perimeter providing a seamless-fold continuity between said two sides of said pad-type filter in the form of a plurality of fold lines, said plurality of fold lines, as connecting segments beginning and ending at the same point, define said seamless outer perimeter, said top side further comprising a plurality of positive and negative secondary creases formed around a plurality of positive and negative crease lines, said crease lines being inclined to said fold lines and forming pleats, said pleats being sealed to form a primary flow aperture such that a fluid passing through said primary flow aperture passes only through at least one of said bottom side, top side and seamless outer perimeter.

* * * * *

UNITED STATES PATENT AND TRADEMARK OFFICE

CERTIFICATE OF CORRECTION

PATENT NO. : 6,736,138 B2
DATED : May 18, 2004
INVENTOR(S) : Amad Tayebi

It is certified that error appears in the above-identified patent and that said Letters Patent is hereby corrected as shown below:

Column 3,
Line 11, claim 1 should read as follows:
1. A method for making a seamless pad-type filter comprising the steps of:
i) providing a sheet of fluid filtration media, said sheet of filtration media having an upper surface and a lower surface and comprising a center point, a central zone, a shaped perimeter and an intermediate zone, said center point being located within said central zone and said central zone being located within said intermediate zone, said shaped perimeter defining the outer edge of said sheet of filtration media, said sheet further comprising a folding zone, said folding zone surrounding said central zone and being surrounded by said intermediate zone,
ii) forming a plurality of primary folds within said folding zone, each of said primary folds being formed around an axis the projection of which lies within said folding zone and forms a fold line which is spaced apart from said center point, said plurality of primary folds, so formed a) creates a plurality of fold lines which, as connecting segments beginning and ending at the same point, define said seamless pad-type filter outer perimeter and b) forms a plurality of positive and negative secondary creases, said secondary creases being formed around a plurality of positive and negative crease lines, respectively, said crease lines being inclined to said fold lines, said plurality of fold lines forming pluralities of positive and negative crease lines, said crease lines shaping said shaped perimeter of said sheet of filtration media into pleats, said pleats forming a primary flow aperture, and
iii) sealing said pleats so formed such that a fluid passing through the primary flow aperture passes only through at least one of the central zone, the intermediate zone and the folding zone.

Signed and Sealed this

Twenty-first Day of September, 2004

JON W. DUDAS
*Director of the United States Patent and Trademark Office*